US005931397A

United States Patent [19]

Herman et al.

[11] Patent Number: 5,931,397

[45] Date of Patent: Aug. 3, 1999

[54] ROTARY GRATING DEVICE

[75] Inventors: Richard N. Herman, 7792 N. Holiday Dr., Sarasota, Fla. 34231; Richard A. Blanchette, Fort Meyers Beach, Fla.

[73] Assignee: Richard N. Herman, Sarasota, Fla.

[21] Appl. No.: 08/546,590

[22] Filed: Oct. 23, 1995

[51] Int. Cl.[6] ..... B02C 18/08; B02C 19/12

[52] U.S. Cl. ..... 241/169.1; 241/273.2; 241/278.1; 241/602

[58] Field of Search ..... 241/273.2, 278.1, 241/602, 167, 169.1

[56] References Cited

U.S. PATENT DOCUMENTS

| | | | |
|---|---|---|---|
| 445,769 | 2/1891 | Chamberlin . | |
| 673,662 | 5/1901 | Schwechler . | |
| 826,896 | 7/1906 | Shaver | 241/602 X |
| 969,204 | 9/1910 | Shaver . | |
| 969,830 | 9/1910 | Agrell . | |
| 1,036,968 | 8/1912 | Craven . | |
| 1,041,754 | 10/1912 | Doolittle | 241/278.1 X |
| 1,095,215 | 5/1914 | Jones . | |
| 1,213,896 | 1/1917 | Palmer et al. . | |
| 1,444,773 | 2/1923 | Bellows | 241/602 X |
| 1,502,347 | 7/1924 | Nelson . | |
| 2,504,900 | 4/1950 | Stollsteimer | 241/278.1 |
| 2,700,995 | 2/1955 | Ritter | 241/278.1 |
| 3,645,310 | 2/1972 | Hartley | 241/273.2 X |

*Primary Examiner*—John M. Husar
*Attorney, Agent, or Firm*—Casey Heeg

[57] ABSTRACT

A device is disclosed for efficiently grating and dispensing blocks of hand soap, comprising a housing and soap grating mechanism. The housing includes a tubular feed tower, a hollow cage and a funnel which collectively define a laterally enclosed passageway through which the soap travels. A grating disc is rotatably mounted in the housing, having an annular rim, a hub and a plurality of spokes connecting the hub and rim so as to define openings through which grated soap may pass. A long, thin, serrated metal band is mounted on the spokes in a continuous spiral between the hub and rim, forming a series of coils which define a planar cutting surface. The band is loosely wound, so that successive coils are spaced apart from each other a sufficient distance to easily permit soap shavings to drop through the space between adjacent coils. The rim of the grating disc comprises a cylindrical bearing surface and a plurality of radially extending gear teeth, which are seated in a stepped annular groove defined by the intersection of the cage and funnel. The feed tower has two rectangular paths into which correspondingly shaped bars of soap are placed, which hold the soap bars in contact with the cutting surface of the grating disc and off-center from its rotational axis. A rotator assembly, comprising a cog keyed to a crank and engaging the gear teeth at the periphery of the grating disc, turns the disc, causing soap shavings to fall through the disc and into the funnel which channels it into the user's hand.

26 Claims, 4 Drawing Sheets

ROTARY GRATING DEVICE

This invention relates generally to the field of rotary devices for grating selected materials, especially fatty materials formed in solid blocks, such as cake soap, cheese and the like, which have a tendency to clog ordinary rotary graters. The invention is particularly well suited for use as a hand soap dispenser, as may be found in public washrooms where the grating and dispensing of measured amounts of soap is desired.

BACKGROUND

A wide assortment of rotary devices have been proposed for grating and dispensing measured amounts of hand soap and other fatty or waxy materials. For example, U.S. Pat. No. 969,204 (Shaver) discloses a soap dispensing machine having a cloverleaf shaped cutting blade axially mounted in an enclosure and coupled to a hand crank for rotating the blade while soap is pressed against its upper surface. U.S. Pat. No. 1,502,347 (Nelson) describes a soap dispenser having a rotating conical cutting surface with curved blades projecting upwardly from the inner surface of the cone, which is peripherally seated on an annular ridge and rotated by a hand cranked beveled gear mounted at its periphery. U.S. Pat. No. 673,662 (Schwechler) discloses yet another rotary design, in which a group of axially projecting serrated blades are mounted in a peripheral ring which is rotatably mounted at the output of a square, tubular enclosure.

While such devices have experienced varying degrees of commercial success, a common problem continues to be the tendency of existing grating devices to clog and/or stall, depending on the design of the cutting mechanism and the consistency of the material being grated. Clogging occurs when the material being grated builds up in the teeth or projections of the cutting blade, causing the blade to slide past the opposing block of material without cutting into it. Stalling occurs when the blade digs so deeply into the material that it becomes difficult or impossible to turn any further. In either event, the cutting effectiveness of the blade is reduced or rendered useless until it is cleared. Moreover, episodes of clogging or stalling generally increase the mechanical loading on the cutting mechanism, resulting in higher material and manufacturing costs for devices designed to handle these loads. Accordingly, there exists a need for a rotary grating device which minimizes or eliminates clogging and stalling, is strong enough to withstand regular use and yet is simple and inexpensive to manufacture.

It is therefore an object of the present invention to provide an improved rotary grating device which addresses these and other deficiencies in prior art designs.

SUMMARY OF THE INVENTION

In accordance with an illustrative embodiment of the present invention, an improved rotary device is disclosed which is designed for efficiently grating and dispensing a selected material, such as hand soap. In one form of the invention, a housing is provided which defines a laterally enclosed passageway having an input end and an output end, with a grating disc rotatably mounted in the housing. The grating disc has an annular rim, a hub and one or more spokes connecting the hub and rim so as to define an open space between the hub and rim through which grated material may pass, with a serrated band spirally mounted on the spoke. The housing and grating disc are mutually configured such that substantially all of the material passing from the input end to the output end of the passageway must pass through the grating disc before exiting, a rotator is coupled to the housing which engages the grating disc so as to selectively induce its rotation.

Another form of the present invention also provides a housing defining a laterally enclosed passageway having an input end and an output end, the housing having an annular groove with opposed groove surfaces encircling the passageway. A grating disc is rotatably mounted in the groove and engages the opposed groove surfaces so as to be restrained against movement in either axial direction. The disc comprises a cutting surface adapted for grating the selected material, the cutting surface having at least one opening through which grated material may pass. The housing and grating disc are mutually configured such that substantially all of the material passing from the input end to the output end of the passageway must pass through the grating disc before exiting, and a rotator is coupled to the housing which engages the grating disc so as to selectively induce its rotation.

Yet another form of the present invention provides a housing defining a laterally enclosed passageway having an input end and an output end, the housing having a tubular feed tower, a cage and a funnel respectively defining an upper, middle and lower portion of the passageway. The cage includes a hollow shell having opposed input and output ports for passage of the selected material and a bearing surface about its inner periphery. The funnel defines an annular ridge encircling the passageway, and is detachably mounted to the cage at the output port. A grating disc is rotatably seated on the annular ridge, having a cutting surface adapted for grating the selected material and a peripheral bearing surface which faces the bearing surface of the cage and is laterally supported by it. A rotator is coupled to the housing, which engages the grating disc so as to selectively induce its rotation.

DESCRIPTION OF THE PREFERRED EMBODIMENT

The invention will be discussed with reference to a preferred embodiment which illustrates the inventive concepts in the context of a stationary, hand-operated device for dispensing grated soap, as may be found in public restrooms and the like. While this embodiment is used for illustrative purposes, it will be understood that the invention lies in the combination of various elements found in the device, and may be practiced in many forms, including but not limited to soap dispensers.

Figure 1:
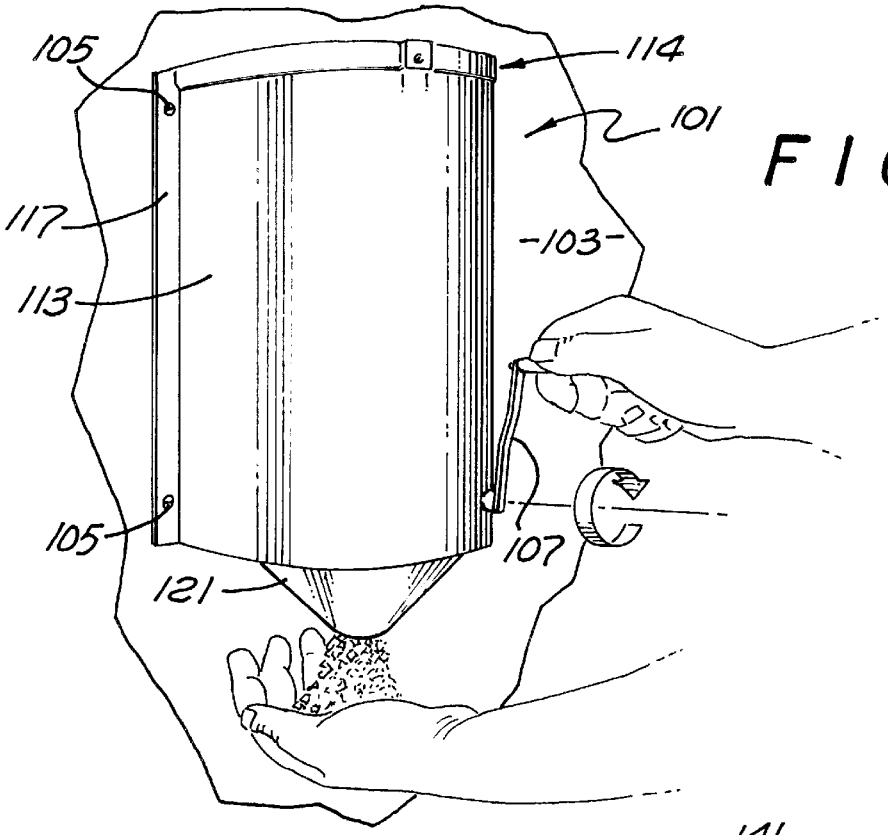
FIG. 1 is a front perspective view of a rotary grating device according to the present invention mounted on a supporting surface, illustrating its use as a soap dispenser.

Referring now to the drawings, FIG. 1 illustrates a grating device, or dispenser 101 according to the invention. Dispenser 101 is shown mounted to a wall 103 by screws 105, and is operated by rotating a hand crank 107 to grate and dispense soap into the user's hand.

Figure 2:
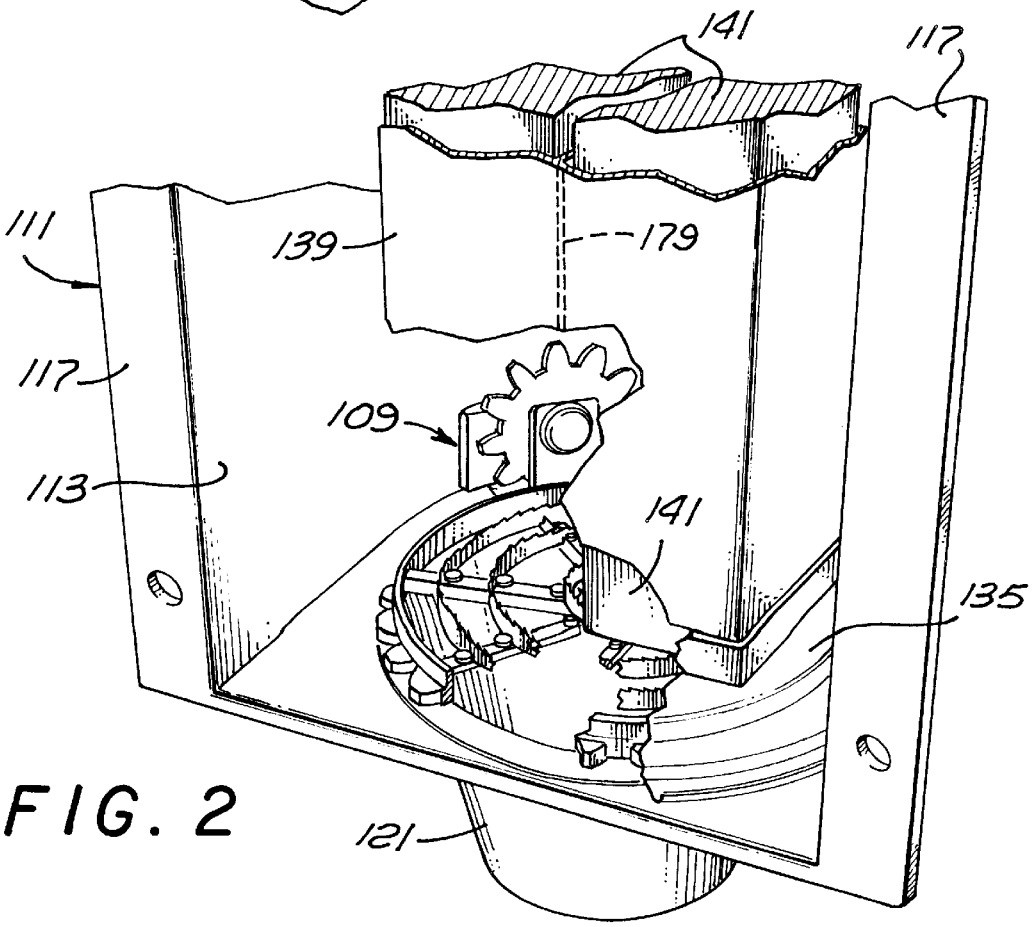
FIG. 2 is a fragmented rear perspective view of the soap dispenser seen in FIG. 1, illustrating the soap grating mechanism.
Figure 3:
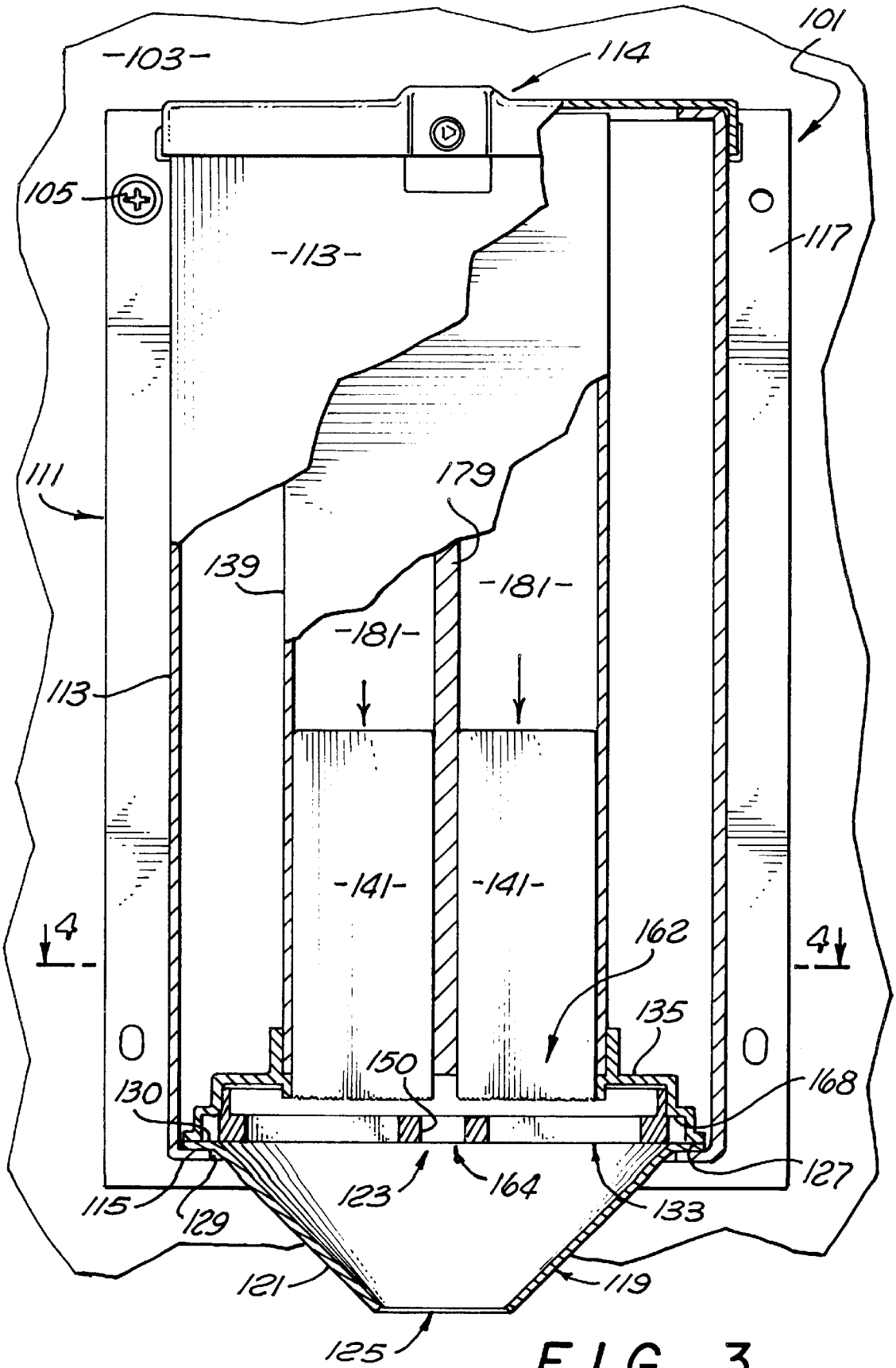
FIG. 3 is a fragmented front elevational view of the soap dispenser of FIG. 1.
Figure 4:
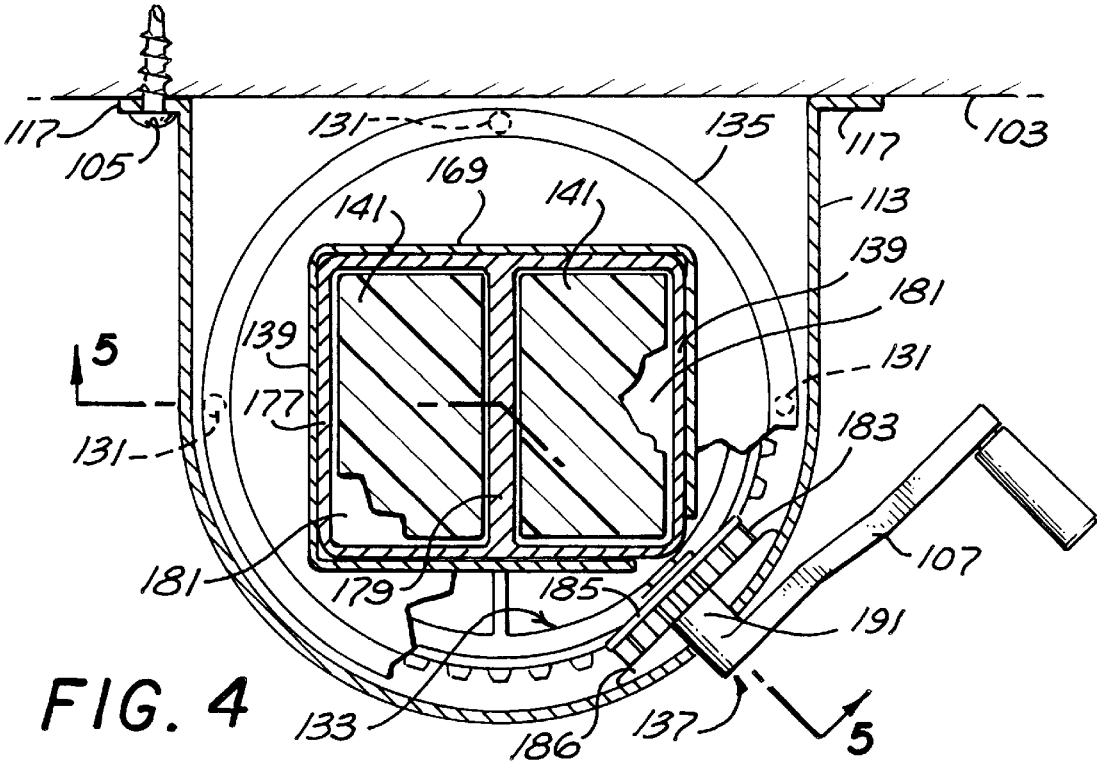
FIG. 4 is a cross-sectional view taken along line 4—4 of FIG. 3.
Figure 5:
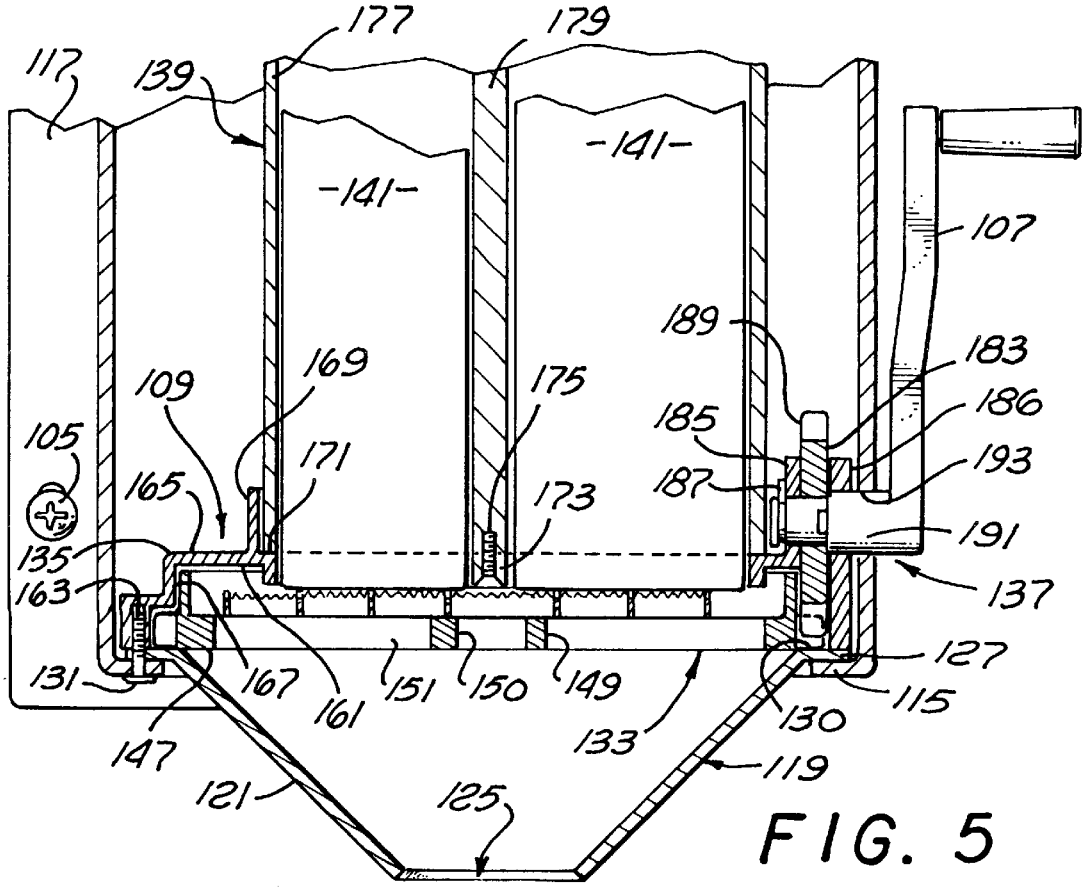
FIG. 5 is a cross-sectional view taken along line 5—5 of FIG. 4.

FIG. 2 is a fragmented perspective view from the back of the dispenser, showing the soap grating mechanism 109 in more detail. Dispenser 101 comprises a plastic enclosure 111, which supports the grating mechanism and protects the contents from contamination by dirt or fluids that may be present in the wash room environment. Enclosure 111 comprises a curved, vertical sheet 113 having a U-shaped cross section, as seen in FIG. 4, and a removable lid 114. The base of sheet 113 bends inwardly, forming a horizontal platform 115 which supports the soap grating mechanism 109, as seen in FIGS. 3 and 5. Vertical flanges 117 bend outwardly from the ends of the U-shaped vertical sheet 113, as seen in FIGS. 2 and 4, enabling the dispenser to be mounted to a wall 103 or other supporting surface by screws 105 or like fasteners.

Funnel 119 is seated in the base of enclosure 111, and comprises a truncated plastic cone 121 having a wide, circular mouth 123 for collecting grated soap and a narrow opening 125 for dispensing the soap into the user's palm. A horizontal flange 127 extends outwardly from the rim of mouth 123, as seen in FIGS. 3 and 5, and rests on platform 115 with cone 121 extending down through a large circular opening 129 in the center of the platform. The transition from horizontal flange 127 to cone 121 defines an annular ridge 130 which provides a bearing surface for soap grating mechanism 109, as discussed below.

Soap grating mechanism 109 is seated on top of funnel 119 and attached to enclosure 111 with screws 131, which extend upwardly through horizontal platform 115 and flange 127 as seen in FIG. 5. Grating mechanism 109 comprises a grating disc 133, cage 135, rotator assembly 137 and feed tower 139. Grating disc 133 is rotatably mounted between funnel 119 and cage 135, with its outer periphery resting on annular ridge 130 as seen in FIGS. 2 and 5 and described more fully below. Feed tower 139 is designed to hold two rectangular bars of soap 141 in contact with the upper face of the grating disc (FIG. 3). When rotated by rotator assembly 137, disc 133 grates the soap into small shavings which drop through the disc and are funneled into the user's hand by cone 121.

Figure 6:
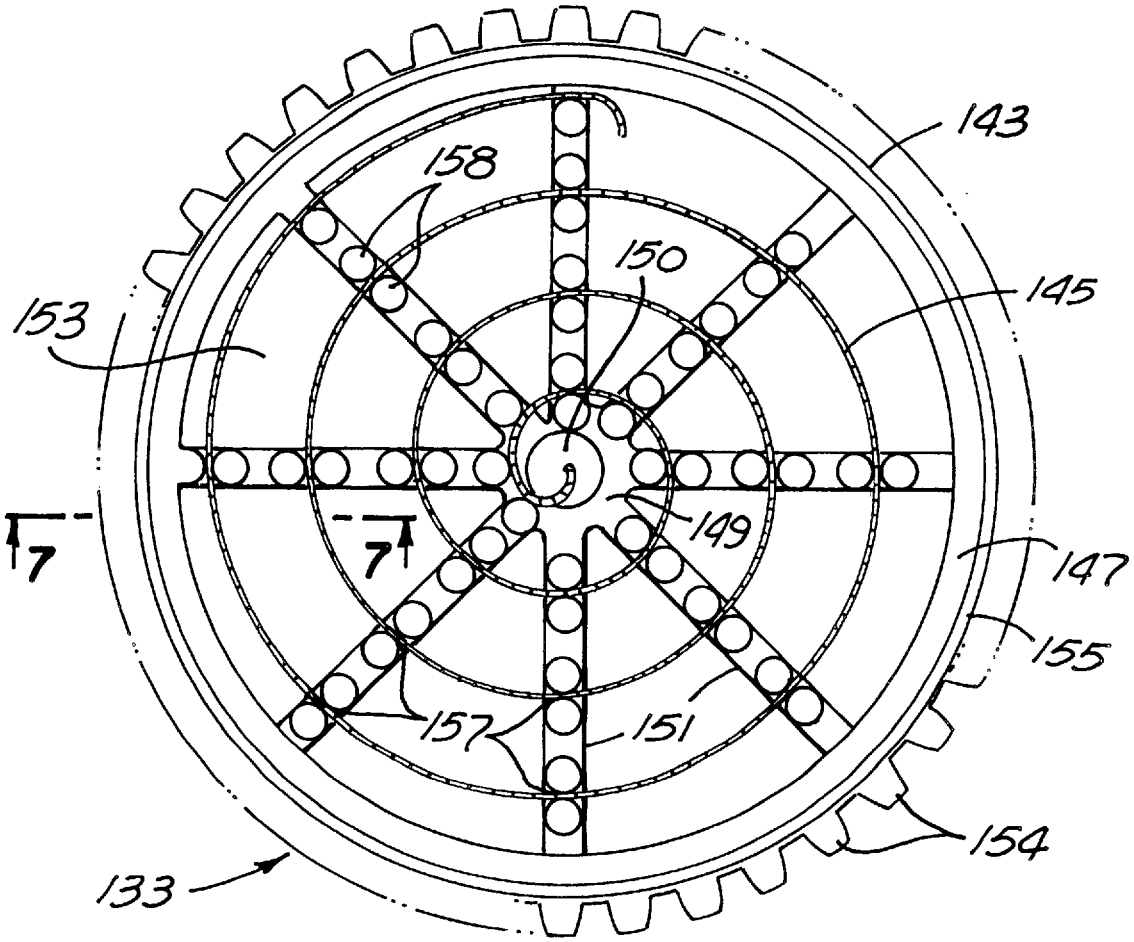
FIG. 6 is a top plan view of a grating disc according to the present invention.
Figure 7:
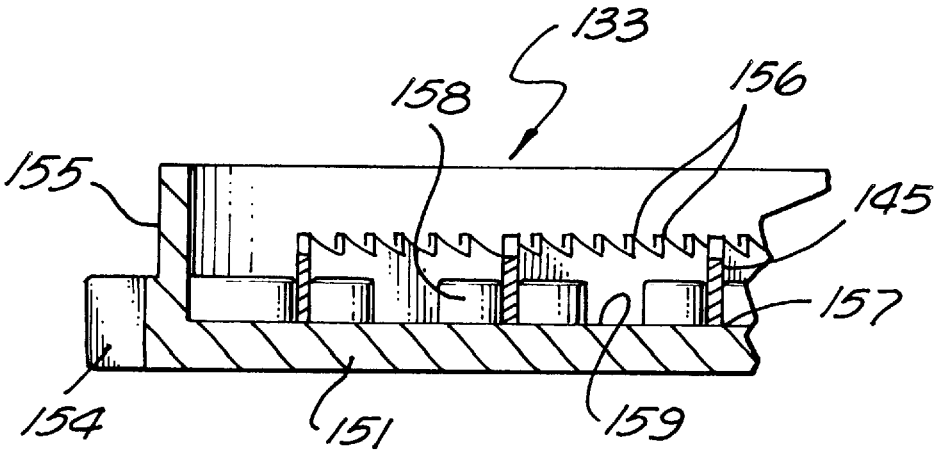
FIG. 7 is a fragmented cross-sectional view of the grating disc of FIG. 6, taken along line 6—6.

As seen in FIGS. 6 and 7, grating disc 133 comprises a molded plastic wheel 143 with a serrated metal band 145 spirally mounted on its upper surface. Wheel 143 comprises an annular rim 147, a central hub 149 with an axially disposed access hole 150, and eight radially oriented spokes 151 connecting the hub to the rim and defining seven pie-slice shaped openings 153 which enable grated soap shavings to pass through disc 133 and into cone 121. The periphery of rim 147 is formed with a plurality of gear teeth 154 extending radially outwardly, enabling the grating disc to be rotated by rotator assembly 137, as described more fully below. A vertical flange 155 with a cylindrical outer surface extends upwardly from rim 147, forming a continuous bearing surface about the periphery of wheel 143 which centers and supports it during rotation.

Band 145 comprises a long, thin flexback bandsaw blade of hardened chrome plated spring steel, with serrated cutting teeth 156 of a hookback design along its upwardly facing edge. It is wound in a continuous spiral from hub 149 to annular rim 147, supported by each of the spokes at a plurality of intersections 157 between the hub and the rim. The band is loosely wound, so that successive coils of the band are spaced apart from each other a sufficient distance to easily permit soap shavings to drop through the space between any two adjacent coils. In the preferred embodiment, which is designed for use with Cra-Z Soap™ or other soaps of similar consistency, grating disc 145 has an outer diameter of 5.112", the height and thickness of the band are 0.25" and 0.03", respectively, cutting teeth 156 are 0.06" high and spaced 6 teeth per inch, the distance between adjacent coils of the band is typically 0.56", and the band spirals through 1,350 degrees of rotation, or 3¾ complete coils. Variations may be made from these dimensions depending on the consistency of the material being grated and the desired size of the shavings, as is well known in the art.

Each of spokes 151 is formed with several pairs of closely spaced, vertically oriented cylindrical posts 158 on its upper surface 159. Band 145 is mounted to the spokes by press fitting it between the pair of posts at each of intersections 157, as seen in FIG. 7, with the lower edge of the band resting against upper surface 159, thus maintaining the cutting teeth in a substantially planar array across the upper face of grating disc 133 so as to form a flat grating surface. The height of the posts is less than the distance from the lower edge of the band to the base of the cutting teeth, so the posts do not interfere with the cutting action of the teeth.

The diameter of grating disc 133 is slightly greater than the inner diameter of annular ridge 130, as seen in FIG. 5, so that at least the outer portion of annular rim 147 rests on and is vertically supported by the ridge, which provides a bearing surface for the rotation of wheel 143. The compositions of flange 127 and annular rim 147 are selected to provide a low friction interface between the two, enabling the grating disc to be easily rotated. The disc rotates freely within cage 135, which traps the wheel between its inner surface 161 and flange 127, restraining the wheel from moving laterally or upwardly.

Cage 135 comprises a hollow, circular plastic shell with opposed input and output ports 162, 164 leading, respectively, to the interiors of feed tower 139 and funnel 119. Cage 135 comprises a peripheral rim with a stepped cross-section, as seen in FIGS. 4 and 5. The lower step 163 of the shell encloses the gear teeth 154 of annular rim 147 between its inner surface 161 and flange 127, while the upper step 165 has a vertical cylindrical inner surface 167 which opposes and fits closely about the outer periphery of vertical flange 155, providing a lateral bearing surface for wheel 143. The intersection of annular ridge 130 with inner surface 161 thus defines a two-step annular groove 168 encircling the passageway defined by feed tower 139, cage 135 and funnel 119. Annular rim 147 is seated in this groove such that the grating disc is fully supported and suspended thereby in the portion of the passageway between feed tower 139 and cone 121. The opposed surfaces of annular groove 168, defined by the upwardly facing horizontal surface of annular ridge 130 and the downwardly facing portions of inner surface 161, support grating disc 133 and restrain it from movement in either axial direction, and the cylindrical inner surface 167 of the annular groove supports the disc and restrains it from lateral movement.

Cage 135 further comprises a square frame 169 which projects upwardly from the top surface of upper step 165, surrounding a narrow ledge 171 and support strut 173 on which feed tower 139 rests. Frame 169 provides lateral support to the feed tower, which is connected to the cage at support strut 173 by screw 175.

Feed tower 139 acts as a guide member for feeding soap into the grating disc. It comprises a square plastic tube 177 with a longitudinal divider 179 extending down the center of the tube and defining two identical tubular paths 181 with rectangular cross-sections, as seen in FIG. 4. The upper and lower ends of the feed tower are open, enabling soap bars 141 to be inserted in the upper end and laterally supported by the walls of the tower while resting against the cutting teeth 156 of grating disc 133, as seen in FIGS. 3 and 5. The non-circular cross sectional shape of tubular paths 181 prevents the correspondingly shaped soap bars from spinning inside the feed tower as the grating disc turns. Additionally, the positioning of paths 181 relative to the grating disc is such that each of the soap bars contacts the upper face of the disc off-center from its rotational axis, minimizing the tendency of the rotating grating disc to make the soap bars spin inside the feed tower and maximizing the grating action of the disc.

Rotator assembly 137 comprises crank 107, cog 183, inner and outer support plates 185 and 186, and circlip 187. Cog 183 is positioned perpendicular to and on the periphery of grating disc 133, with its teeth 189 engaging gear teeth 154 of the disc. The cog is keyed to shaft 191 of crank 107, so as to rotate when the crank is turned. Shaft 191 passes through a hole 193 in enclosure 111 and is journaled in inner support plate 185 on one side of the cog and outer support plate 186 on the other side. Inner support plate 185 is formed as part of cage 135, projecting vertically upwardly from the top surface thereof. Outer support plate 186 is fixed to the inner surface of vertical sheet 113, as by glue or the like.

In operation, dispenser 101 is loaded by removing lid 114 and placing a soap bar 141 into each of the paths 181 in feed tower 139. When crank 107 is turned, cog 183 rotates, causing grating disc 133 to rotate inside cage 135. Serrated band 145 rotates with the disc, causing cutting teeth 156 to scrape across the bottom surfaces of soap bars 141, grating the soap into fine shavings. The spiral mounting of band 145 prevents teeth 156 from digging concentric grooves in the soap bars, thus avoiding the clogging problem commonly found with other rotary grating mechanisms. The soap shavings fall from the spiral band through the pie-slice shaped openings 153 of wheel 143, and into cone 121, which funnels them through cone opening 125 into the user's hand.

Having thus described the structure and operation of the preferred embodiment in detail, it will be seen that dispenser 101 is a device for grating a selected material, such as Cra-Z Soap™. The feed tower 139, cage 135 and funnel 119 form a housing which defines a laterally enclosed passageway having an input end at the top of feed tower 139 and an output end at the opening 125 of the funnel. Grating disc 133 is rotatably mounted in this housing, and comprises an annular rim 147, a hub 149 and spokes 151 connecting the hub and rim so as to define openings 153 between the hub and rim through which grated soap may pass, and a serrated band 145 spirally mounted on the spokes. The housing and grating disc are mutually configured such that all or substantially all of the soap passing from the input end to the output end must pass through the grating disc before exiting the enclosed passageway. Rotator assembly 137 is coupled to the housing and engages the grating disc so as to selectively induce rotation of the disc when crank 107 is turned.

From the foregoing description it will be apparent that variations may be made in the disclosed device without departing from the basic principles of the various aspects of this invention. For example, while the preferred embodiment is designed for stationary operation as a soap dispenser, the invention works equally well for grating other materials, especially fatty or waxy materials having a consistency similar to that of cake soap, which have a tendency to clog ordinary rotary graters. One such use would be for grating cheese, in which case the dispenser may be designed for hand held use rather than wall mounting. Similarly, the dispenser could incorporate other mechanisms for rotating the grating disc, including electrically powered rotary mechanisms, as are well known in the art. Other variations may be made in the size and shape of the dispenser, to suit the type of grating operation for which it will be used. Likewise, grating devices according to the invention may be made from other materials than those described above, using other manufacturing methods as are well known in the art.

Many other modifications to the invention disclosed above will be apparent to those skilled in the art, and it should be understood that this invention includes all modifications falling within the scope of the following claims.

We claim:

1. A device for grating a selected material, comprising:

a housing defining a laterally enclosed passageway having an input end and an output end;

a grating disc rotatably mounted in said housing; said grating disc comprising an annular rim, a hub and at least one spoke connecting said hub and rim so as to define an open space between the hub and rim through which grated material may pass, and a serrated band spirally mounted on said spoke;

said housing and grating disc being mutually configured such that substantially all of the material passing from said input end to said output end must pass through said grating disc before exiting said enclosed passageway; and a rotator coupled to said housing and engaging said grating disc so as to selectively induce rotation thereof.

2. A device as set forth in claim 1, wherein said spiral band defines a plurality of coils with adjacent coils separated by sufficient space to permit grated material to pass therebetween.

3. A device as set forth in claim 2, wherein said band is mounted in a continuous spiral supported by said at least one spoke at a plurality of intersections between said hub and rim.

4. A device as set forth in claim 3, wherein the serrations of said band lie in substantially the same plane across the face of said grating disc so as to form a flat grating surface.

5. A device as set forth in claim 1, wherein said housing comprises an annular ridge on which said annular rim is seated, said disc being supported by said ridge.

6. A device as set forth in claim 5, wherein said disc is suspended in said passageway by said annular rim.

7. A device as set forth in claim 6, wherein said rim comprises a peripheral bearing surface opposing a correspondingly shaped portion of said housing and laterally supported thereby.

8. A device as set forth in claim 7, wherein said rim comprises a plurality of gear teeth projecting radially outwardly and said rotator comprises a cog mounted at the periphery of said grating disc so as to engage said gear teeth.

9. A device as set forth in claim 8, wherein said housing further comprises an annular groove having opposed groove surfaces encircling said passageway, said annular rim being rotatably mounted in said annular groove and engaging said opposed groove surfaces so as to be restrained thereby against movement in either axial direction.

10. A device as set forth in claim 9, wherein said annular groove has a cross sectional shape comprising a plurality of steps, one of said steps enclosing said gear teeth and another of said steps enclosing said peripheral bearing surface.

11. A device as set forth in claim 10, wherein said band is mounted in a continuous spiral defining a plurality of coils supported by said at least one spoke at a plurality of intersections between said hub and rim, with adjacent coils separated by sufficient space to permit grated material to pass therebetween, and wherein the serrations of said band lie in substantially the same plane across the face of said grating disc so as to form a flat grating surface;

wherein said housing comprises a cage enclosing said grating disc and having opposed input and output ports for passage of the selected material, a tubular feed tower mounted to said input port and a funnel mounted to said output port, said passageway being defined by the interior surfaces of said feed tower, cage and funnel and said annular groove defined by the intersection of said funnel with said cage;

said feed tower defining at least one tubular path having a non-circular cross section and intersecting said grating disc off-center from the axis of rotation of said disc.

12. A device as set forth in claim 1, wherein said housing comprises a cage enclosing said grating disc and having opposed input and output ports for passage of the selected material.

13. A device as set forth in claim 12, wherein said housing further comprises a tubular feed tower mounted to said input port and a funnel mounted to said output port, said passageway being defined by the interior surfaces of said feed tower, cage and funnel.

14. A device as set forth in claim 13, wherein said housing comprises an annular ridge on which said annular rim is seated, said disc being supported by said ridge.

15. A device as set forth in claim 14, wherein said housing further comprises an annular groove defined by the intersection of said funnel with said cage and having opposed groove surfaces encircling said passageway, said annular rim being rotatably mounted in said annular groove and engaging said opposed groove surfaces so as to be restrained thereby against movement in either axial direction.

16. A device as set forth in claim 1, wherein said housing comprises a tower for feeding the selected material onto the grating disc, said feed tower defining at least one tubular path intersecting said grating disc off-center from the axis of rotation of said disc.

17. A device as set forth in claim 16, wherein said tubular path has a non-circular cross section.

18. A device for grating a selected material, comprising:

a housing defining a laterally enclosed passageway having an input end and an output end, said housing comprising a tubular feed tower, a cage and a funnel respectively defining an upper, middle and lower portion of said passageway;

said cage comprising a hollow shell having opposed input and output ports for passage of the selected material and a bearing surface about its inner periphery;

said funnel defining an annular ridge encircling said passageway and being detachably mounted to said cage at said output port;

a grating disc rotatably seated on said annular ridge, comprising a cutting surface adapted for grating the selected material and a peripheral bearing surface facing said bearing surface of said cage and laterally supported thereby; and a rotator coupled to said housing and engaging said grating disc so as to selectively induce rotation thereof.

19. A device as set forth in claim 18, wherein said housing further comprises an annular groove defined by the intersection of said funnel with said cage and having opposed groove surfaces encircling said passageway, said grating disc being rotatably mounted in said annular groove and engaging said opposed groove surfaces so as to be restrained thereby against movement in either axial direction.

20. A device as set forth in claim 19, wherein the outermost peripheral portion of said grating disc comprises a plurality of gear teeth projecting radially outwardly and said rotator comprises a cog mounted at the periphery of said grating disc so as to engage said gear teeth.

21. A device as set forth in claim 20, wherein said cage has a cross sectional shape comprising a plurality of steps, one of said steps enclosing said gear teeth and another of said steps enclosing said peripheral bearing surface of said grating disc.

22. A device as set forth in claim 21, wherein said rotator further comprises a crank rotatably mounted in said housing and said cog is keyed to the shaft of said crank so as to rotate said grating disc when said crank is turned.

23. A device as set forth in claim 22, wherein said cutting surface has at least one opening through which grated material may pass; and said housing and grating disc being mutually configured such that substantially all of the material passing from said input end to said output end must pass through said grating disc before exiting said enclosed passageway.

24. A device as set forth in claim 23, wherein the outermost peripheral portion of said grating disc is seated in said annular groove and the central portion of said disc is suspended in said passageway by said peripheral portion;

said feed tower defining at least one tubular path having a non-circular cross section and intersecting said grating disc off-center from the axis of rotation of said disc.

25. A device as set forth in claim 18, said feed tower defining at least one tubular path intersecting said grating disc off-center from the axis of rotation of said disc.

26. A device as set forth in claim 25, wherein said tubular path has a non-circular cross section.

* * * * *